US007377299B2

(12) United States Patent
Gerber et al.

(10) Patent No.: US 7,377,299 B2
(45) Date of Patent: May 27, 2008

(54) PURSE WITH MALLEABLE HANDLES

(76) Inventors: Danielle Evin Gerber, 519 E. 72nd St. Suite 203-A, New York, NY (US) 10021; Rock Positano, 519 E. 72nd St. Suite 203-A, New York, NY (US) 10021

( * ) Notice: Subject to any disclaimer, the term of this patent is extended or adjusted under 35 U.S.C. 154(b) by 221 days.

(21) Appl. No.: 11/042,274

(22) Filed: Jan. 24, 2005

(65) Prior Publication Data

US 2006/0162830 A1 Jul. 27, 2006

(51) Int. Cl.
*A45C 13/26* (2006.01)

(52) U.S. Cl. ..... 150/108; 190/39; 190/117; 220/764; 220/772

(58) Field of Classification Search ..... 150/107, 150/108, 110; 190/39, 115–117, 118; 16/114.1, 16/902, 113.1; 383/4, 22, 23; 220/756, 220/757, 764, 772
See application file for complete search history.

(56) References Cited

U.S. PATENT DOCUMENTS

| | | | | | |
|---|---|---|---|---|---|
| 119,293 | A * | 9/1871 | Alexandre | 190/115 |
| 1,047,941 | A * | 12/1912 | Hollingsworth | 190/115 |
| 2,031,218 | A * | 2/1936 | Klotz | 190/115 |
| 2,745,524 | A * | 5/1956 | Plotkin | 190/115 |
| 3,016,939 | A * | 1/1962 | Lowy | 150/110 |
| 3,061,157 | A * | 10/1962 | Moss | 224/484 |
| 3,519,110 | A * | 7/1970 | Siris | 16/114.1 |
| 3,912,141 | A * | 10/1975 | Appel | 150/108 |
| 4,023,842 | A | 5/1977 | Harvey | |
| 4,153,092 | A * | 5/1979 | Haslam | 150/108 |
| 4,341,410 | A | 7/1982 | Summach | |
| 4,856,570 | A * | 8/1989 | Rushing et al. | 150/107 |
| 6,076,783 | A | 6/2000 | Card | |
| 6,097,448 | A * | 8/2000 | Perkins | 348/837 |
| 6,138,881 | A * | 10/2000 | Paul et al. | 224/153 |
| 6,317,924 | B1 * | 11/2001 | Gallagher | 16/114.1 |
| 6,488,189 | B1 * | 12/2002 | Smith | 224/201 |
| 6,494,619 | B1 | 12/2002 | Sulpizio | |
| 6,666,363 | B2 * | 12/2003 | Godshaw et al. | 224/578 |
| 6,698,474 | B1 | 3/2004 | Trsek | |
| 2003/0150082 | A1 * | 8/2003 | Chen | 16/114.1 |
| 2004/0039316 | A1 * | 2/2004 | Smith | 602/6 |
| 2004/0068838 | A1 * | 4/2004 | Tsai | 16/114.1 |
| 2004/0089686 | A1 * | 5/2004 | Pratt et al. | 224/265 |
| 2004/0154131 | A1 * | 8/2004 | Earley et al. | 16/406 |
| 2005/0126873 | A1 * | 6/2005 | Matsumoto | 190/115 |

FOREIGN PATENT DOCUMENTS

| | | | |
|---|---|---|---|
| GB | 2214490 A | * | 9/1989 |
| GB | 2262511 A | * | 6/1993 |

* cited by examiner

*Primary Examiner*—Sue A. Weaver
(74) *Attorney, Agent, or Firm*—Amster, Rothstein & Ebenstein LLP

(57) ABSTRACT

A purse including an article storage assembly and at least two handles. Each of the at least two handles includes a first handle portion having a first end attached to the article storage assembly and a second end, and a second handle portion having a first end attached to the article storage assembly and a second end removeably attached to the second end of the first handle portion. The first and second handle portions are shapeable into various substantially rigid configurations.

9 Claims, 4 Drawing Sheets

PURSE WITH MALLEABLE HANDLES

TECHNICAL FIELD

The present invention is related to handles for bags, particularly handbags and purses.

BACKGROUND OF THE INVENTION

A purse is often considered an important fashion accessory. Most purses are designed to keep up with the latest trends and to conveniently and effectively carry many items without hindering the purse-wearer's ability to move about comfortably.

A purse's handles limit the way in which the purse can be worn. For example, with the conventional leather strap handles, a purse-wearer basically has two options: (1) place the straps over the arm or shoulder; or (2) simply carry the purse in hand. However, when a purse becomes heavy, it is inconvenient and often painful to carry the purse in these ways.

Further, the conventional handles limit the way the purse can be set aside when the purse-wearer is at rest. For example, women typically store their purse on the floor or on an adjacent seat when they sit down at, for example, a restaurant or movie theater. Thus, the purse and/or its contents become vulnerable to theft and, since public floors are typically quite dirty, the bottom of the purse is often soiled, which is especially unwanted in the case of expensive designer purses. Also, it is difficult to access a purse from a sitting position when the purse is placed on the floor or an adjacent seat.

Accordingly, there is a need for a purse with handles that allow the purse to be comfortably worn even when the purse becomes heavy and that allow the purse to be stored safely and conveniently.

SUMMARY OF THE INVENTION

A purse according to an exemplary embodiment of the invention includes an article storage assembly and at least two handles. Each of the at least two handles includes a first handle portion having a first end attached to the article storage assembly and a second end, and a second handle portion having a first end attached to the article storage assembly and a second end removeably attached to the second end of the first handle portion. The first and second handle portions are shapeable into various substantially rigid configurations.

In at least one embodiment, the second end of the first handle portion is attached to the second end of the second handle portion by a clasp.

In at least one embodiment, each of the first and second handle portions includes an inner core made of a bendable material, and an outer layer that covers the inner core.

In at least one embodiment, a portion of the outer layer extends past the first end of a corresponding one of the first and second handle portions, and the portion of the outer layer is fastened to the article storage assembly.

In at least one embodiment, the bendable material is a metal.

In at least one embodiment, the material is deformable substantially inelastically.

In at least one embodiment, each of the first and second handle portions includes a length adjusting apparatus that adjusts the length of a corresponding one of the first and second handle portions.

In at least one embodiment, the length adjusting apparatus includes a handle portion base having a first end attached to the article storage assembly and a second end interconnected with the first end of a corresponding one of the first and second handle portions. A protrusion extends from one of the handle portion base and a corresponding one of the first and second handle portions. A groove extends longitudinally along the other of the handle portion base and a corresponding one of the first and second handle portions, and the protrusion extends through the groove.

A purse according to another exemplary embodiment of the invention includes an article storage assembly and at least two handles attached to the article storage assembly. Each of the at least two handles includes at least two separable handle portions, each of the at least two handle portions being flexible substantially inelastically.

A purse according to another exemplary embodiment of the invention includes an article storage assembly and at least one handle, the at least one handle including at least two separable handle portions. Each of the at least two handle portions are shapeable into various substantially rigid configurations.

These and other features of this invention are described in, or are apparent from, the following detailed description of various exemplary embodiments of this invention.

BRIEF DESCRIPTION OF THE DRAWINGS

Various exemplary embodiments of this invention will be described in detail, with reference to the following figures, wherein.

DETAILED DESCRIPTION OF PREFERRED EMBODIMENTS

The purse according to various exemplary embodiments of the present invention includes handles that are preferably flexible, yet strong enough to be bent into various substantially rigid configurations, such as, for example, hooks, depending on the need. That is, the inventive handles preferably exhibit substantially inelastic behavior when bent into various shapes.

Figure 1:
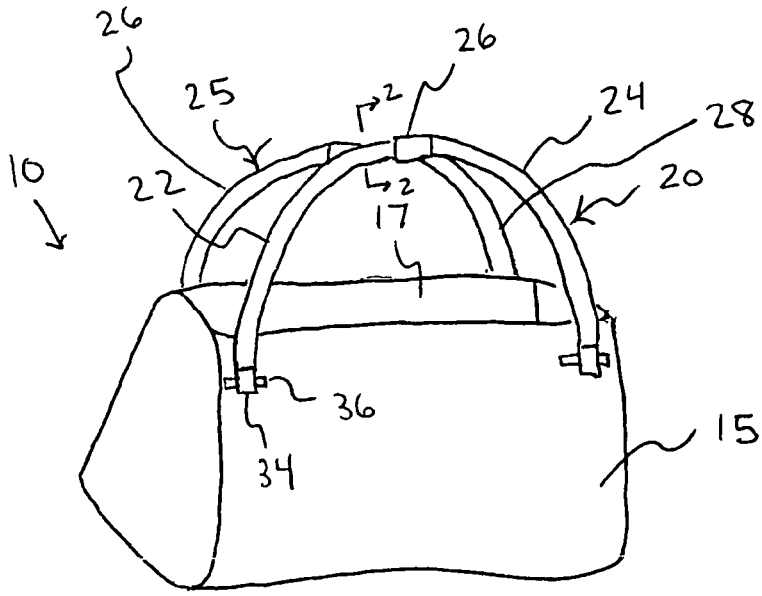
FIG. 1 shows a purse according to an exemplary embodiment of the invention.

FIG. 1 shows a purse 10 according to an exemplary embodiment of the invention. The purse 10 includes an article storage assembly 15, a first handle 20 and a second handle 25. The article storage assembly 15 includes an opening 17 through which items may be passed for storage inside the article storage assembly 15. The article storage assembly 15 is shown in FIG. 1 as including a single pouch and opening 17. However, it should be appreciated that the article storage assembly 15 may include, for example, any one of a combination of pouches, folds, clasps, buttons and openings to allow for the storage of articles of varying size and weight.

The first handle 20 is made up of a first handle portion 22 and a second handle portion 24, and the second handle 25 is made up of a third handle portion 26 and a fourth handle portion 28. The second handle 25 preferably has the same structure as the first handle 20, and thus further description of the second handle 25 will not be included here.

One end of each of the first and second handle portions 22, 24 is attached to the article storage assembly 15. The opposite ends of the first and second handle portions 22, 24 are removeably attached to one another by any suitable means, such as, for example, a clasp 26.

Figure 2:
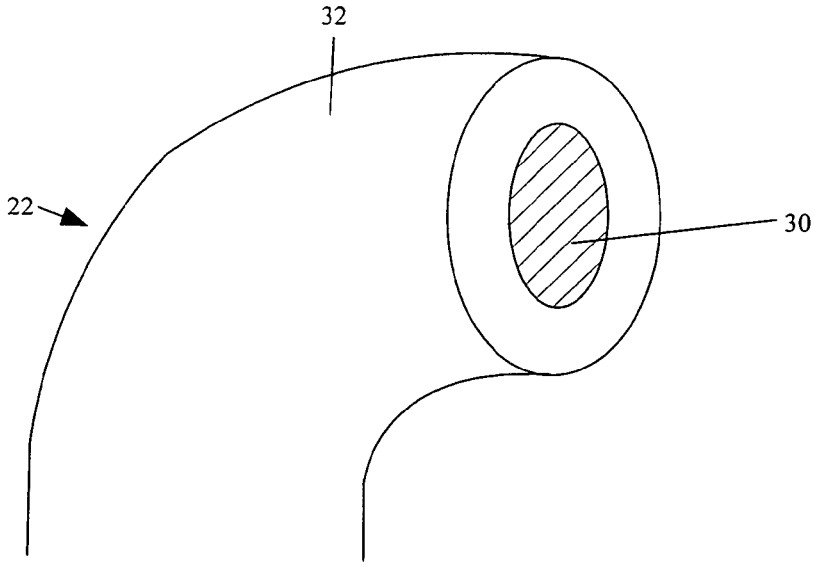
FIG. 2 is a cross-sectional view of a handle taken along the line 2-2 in FIG. 1.

FIG. 2 is a cross sectional view of the first handle portion 22 taken along the line 2-2 of FIG. 1. As shown in FIG. 2, the first handle portion 22 includes a relatively rigid core element 30 and an outer layer 32 formed over the core element 30. Although the core element 30 is shown in FIG. 2 as having a circular cross-sectional shape, the core element 30 may have any other suitable cross-sectional shape, such as, for example, octagonal, flat and rectangular. The core element 30 may also be textured to include, for example, ribs and ridges. The core element 30 may be bent into various shapes. Thus, the core element 30 is preferably made of rigid, yet malleable materials, such as, for example, aluminum and other light weight metals. The outer layer 32 may be formed of any suitable materials, such as, for example, leather. The outer layer 32 may also be textured to include, for example, ribs and ridges, so as to provide enhanced grip. It should be appreciated that, in other embodiments of the invention, the outer layer 32 may be eliminated and the core element 30 may be exposed to provide the purse 10 with a "stark" look. In general, the handle portions may be include any suitable material, such as, for example, bamboo, plastic, wire, wood, leather, fur, sheepskin, straw, wicker, neoprene, ceramic, glass, foil, bakelite, celluloid, recycled material, yarn, and fabrics and may have any suitable construction, such as, for example, linked leather, woven leather, chain, woven fur, neoprene with wire inside, fabrics with wire inside, fabric wrapped metals and other fabric wrapped materials. The outer layer 32 may be extended past the end of the core element 30 to allow the outer layer 32 to be fastened to the article storage assembly 15. For example, as shown in FIG. 1, the portion of the outer layer 32 extending past the end of the core element 30 may be formed into a loop 34, and the loop 34 may be attached to hook 36 on the article storage assembly 15. The first and second handle portions 22, 24 may be attached to the article storage assembly by any other suitable means, such as, for example, rivets or buckles. The second, third and fourth handle portions 24, 26 and 28 preferably have the same structure as that of the first handle portion 22.

Figure 3:
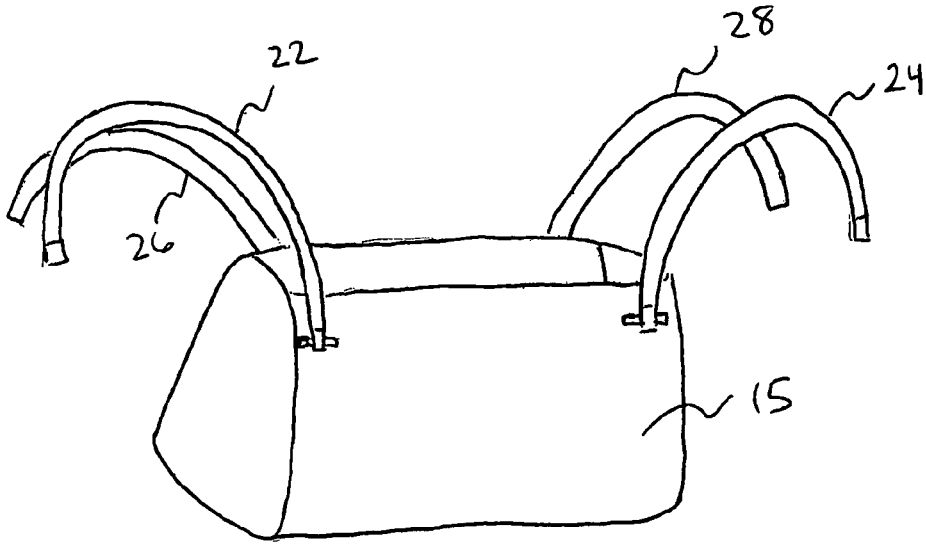
FIG. 3 shows the purse of FIG. 1 with the handles unclasped and arranged in a first configuration.

As shown in FIG. 1, the first handle portion 22 may be clasped to the second handle portion 24 and the third handle portion 26 may be clasped to the fourth handle portion 28 so that the first and second handles 20, 25 may be used to carry the purse 10 over the shoulder or in hand. However, when the first handle portion 22 is unclasped from the second handle portion 24 and the third handle portion 26 is unclasped from the fourth handle portion 28, the malleable nature of each of the handles 22, 24, 26 and 28 allows them to be independently shaped into various configurations. In essence, the handles 22, 24, 26 and 28 may be bent or otherwise shaped to follow any circuitous path. For example, as shown in FIG. 3, each of the handles 22, 24, 26, 28 may be bent into hooks extending away from the article storage assembly 15. With this configuration, the handles 22, 24, 26, 28 may be hooked on to various parts of the body or to the back of a chair, for example. As another example, with the handle portions 22, 24, 26, 28 configured as in FIG. 3, the purse 10 may be worn as a backpack.

Figure 4:
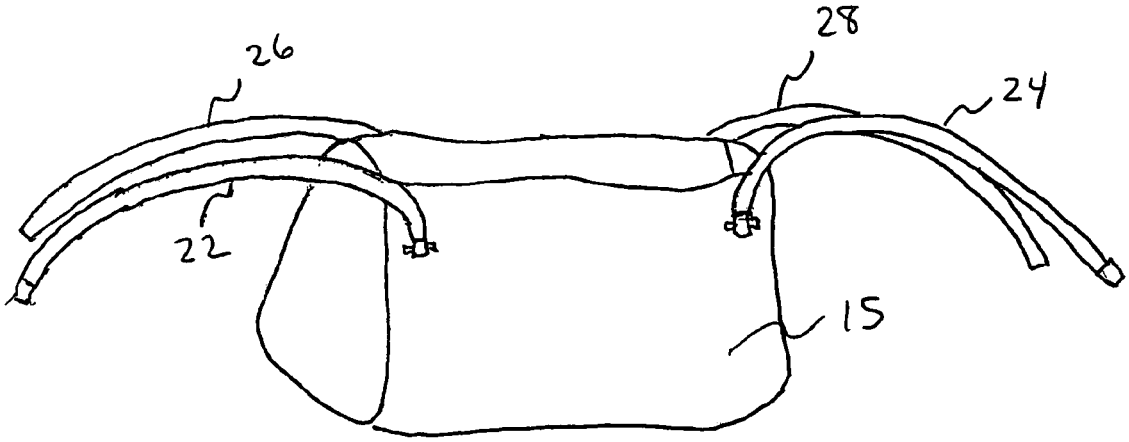
FIG. 4 shows the purse of FIG. 1 with the handles unclasped and arranged in a second configuration.
Figure 5:
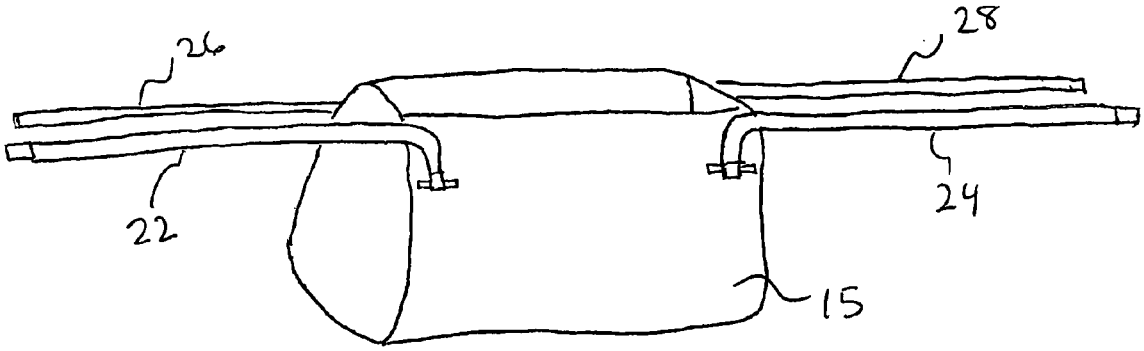
FIG. 5 shows the purse of FIG. 1 with the handles unclasped and arranged in a third configuration.

FIGS. 4 and 5 show other examples of handle configurations for the purse 10. As shown in FIG. 4, the handle portions 22, 24, 26, 28 may be bent downwards away from the article storage assembly 15. With this configuration, while a user is sitting, one set of handle portions 22 and 26 may be hooked over the user's knee and another set of handle portions 24 and 28 may be hooked over the user's other knee. Thus, the user may have easy access to the contents of the purse 10 when sitting down in a movie theater, for example, and the purse 10 can be kept safe. Similarly, as shown in FIG. 5, each set of handle portions 22, 26 and 24, 28 may be straightened to extend away from the article storage assembly 15, which would allow the purse 10 to be placed in the lap of a user with the handle portions resting on the user's legs.

Figure 6:
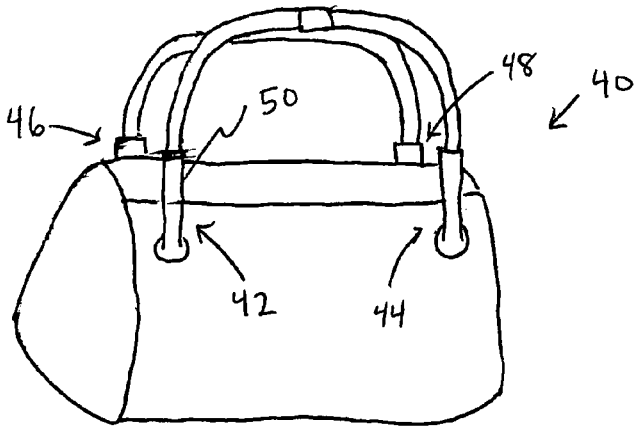
FIG. 6 shows a purse according to another exemplary embodiment of the invention.
Figure 7:
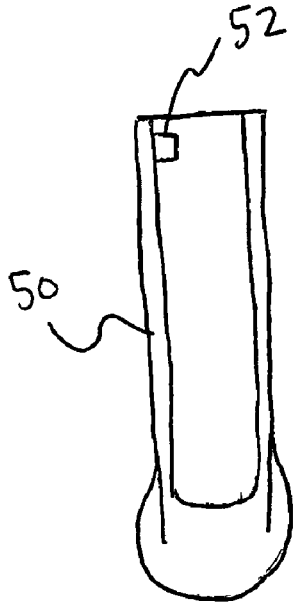
FIG. 7 is a cross-sectional view of a handle portion base according to an exemplary embodiment of the invention.
Figure 8:
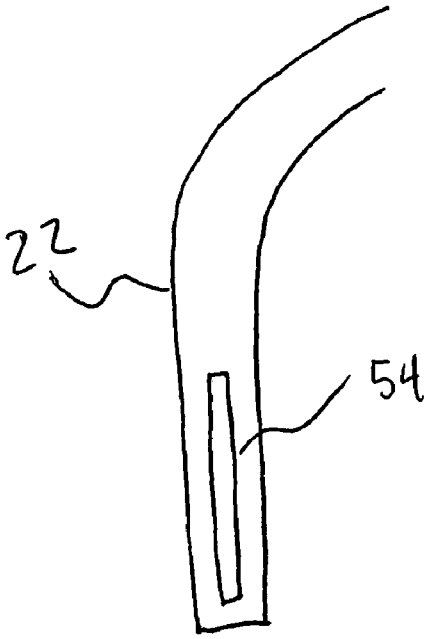
FIG. 8 shows a groove formed in a handle portion according to an exemplary embodiment of the invention.

FIG. 6 shows a purse 40 according to another exemplary embodiment of the invention. The purse 40 shares the same features as that of the purse 10 of the previous embodiment, with the addition of a handle length adjusting apparatus at each handle portion 22, 24, 26, 28. In particular, each of the handle length adjusting apparatuses 42, 44, 46, 48 may include a handle portion base 50 having a first end attached to the article storage assembly 15. As shown in FIG. 7, each handle portion base 50 is formed of a tube-like structure. A protrusion 52 may be formed extending from an inner wall of each handle portion base 50. The inner diameter of each handle portion base 50 is preferably larger than the outer diameter of the corresponding handle portion 22, 24, 26, 28, so that an end of each handle portion 22, 24, 26, 28 may be slid into a corresponding handle base portion 50. As shown in FIG. 8, each handle portion 22, 24, 26, 28 has a longitudinal groove 54 extending partially along its length. The protrusion 52 of each handle portion base 50 extends through a corresponding groove 54 of the handle portions 22, 24, 26, 28. With this construction, the length of each handle portion 22, 24, 26, 28 can be adjusted simply by lifting or pushing the handle portion 22, 24, 26, 28 into or out of its corresponding handle portion base 50. The length adjustment is limited by the protrusion's 52 contact with the ends of the grooves 54.

It should be appreciated that the length adjusting apparatuses are not limited to the construction discussed above. For example, in other embodiments of the invention, the outer diameter of each handle portion base may be smaller than the inner diameter of the corresponding handle portion so that each handle portion base may be inserted into a corresponding handle portion. As another variation, a longitudinal groove may be formed in each handle portion base, and a protrusion may be formed on each handle portion to slide within the grooves.

The length adjusting apparatuses 42, 44, 46, 48 allow for additional flexibility in adjusting the configuration of the handle portions 22, 24, 26, 28. For example, when fully extended and bent into hooks, the handle portions 22, 24, 26, 28 may more effectively allow the purse 10 to function as a backpack.

While particular embodiments of the present invention have been illustrated and described, it would be obvious to those skilled in the art that various other changes and modifications can be made without departing from the spirit and scope of the invention. For example, although the inventive purse has been described as having two handles, with two handle portions per handle, any number of malleable handles and handle portions may be included. It is therefore intended to cover in the appended claims all such changes and modifications that are within the scope of this invention.

What is claims is:

1. A purse comprising:

an article storage assembly;

at least two handles, each of the at least two handles comprising:

a first handle portion having a first end attached to the article storage assembly and a second end;

a second handle portion having a first end attached to the article storage assembly and a second end removeably attached to the second end of the first handle portion; and a means for maintaining the first and second handle portions in a plurality of substantially rigid first configurations when the second end of the first handle portion is attached to the second end of the second handle portion and for maintaining the first and second handle portions in a plurality of substantially rigid second configurations when the second end of the first handle portion is separated from the second end of the second handle portion.

2. The purse of claim 1, wherein the second end of the first handle portion is attached to the second end of the second handle portion by a clasp.

3. The purse of claim 1, wherein the means for maintaining comprises an inner core of the first and second handle portions, the inner core being made of a bendable material.

4. The purse of claim 3, further comprising an outer layer that covers the inner core, a portion of the outer layer extending past the first end of a corresponding one of the first and second handle portions, the portion of the outer layer being fastened to the article storage assembly.

5. The purse of claim 3, wherein the bendable material is a metal.

6. The purse of claim 3, wherein the bendable material is deformable substantially inelastically.

7. The purse of claim 1, wherein each of the first and second handle portions comprises a length adjusting apparatus that adjusts the length of a corresponding one of the first and second handle portions.

8. The purse of claim 7, wherein the length adjusting apparatus comprises:

a handle portion base having a first end attached to the article storage assembly and a second end interconnected with the first end of a corresponding one of the first and second handle portions;

a protrusion extending from one of the handle portion base and a corresponding one of the first and second handle portions; and a groove extending longitudinally along the other of the handle portion base and a corresponding one of the first and second handle portions, the protrusion extending through the groove.

9. A purse comprising:

an article storage assembly;

at least two handles attached to the article storage assembly, each of the at least two handles comprising at least two separable handle portions, each of the at least two handle portions comprising a means for allowing the handle portion to flex substantially inelastically to a plurality of substantially rigid first configurations and for allowing the handle portion to flex substantially inelastically to a plurality of substantially rigid second configurations when the handle portion is separated from the other of the at least two handle portions.

* * * * *